US009284776B2

(12) United States Patent
Bond

(10) Patent No.: US 9,284,776 B2
(45) Date of Patent: Mar. 15, 2016

(54) ENTERTAINMENT TABLE

(76) Inventor: William Ralph Bond, Woodbridge, VA (US)

( * ) Notice: Subject to any disclaimer, the term of this patent is extended or adjusted under 35 U.S.C. 154(b) by 1545 days.

(21) Appl. No.: 12/589,060

(22) Filed: Oct. 19, 2009

(65) Prior Publication Data

US 2011/0088974 A1 Apr. 21, 2011

(51) Int. Cl.

| | |
|---|---|
| ***E06C 7/14*** | (2006.01) |
| ***E06C 7/00*** | (2006.01) |
| ***A47B 13/00*** | (2006.01) |
| ***A47B 31/00*** | (2006.01) |
| *E06C 7/16* | (2006.01) |

(52) U.S. Cl.

CPC . *E06C 7/00* (2013.01); *A47B 13/00* (2013.01); *A47B 31/00* (2013.01); *E06C 7/14* (2013.01); *E06C 7/16* (2013.01)

(58) Field of Classification Search

CPC ..... E06C 1/00; E06C 1/005; E06C 1/02; E06C 7/16; E06C 7/14; E06C 7/165; E06C 1/39

USPC ..... 182/181.1, 28, 119, 230; 108/24–26; 99/448

See application file for complete search history.

(56) References Cited

U.S. PATENT DOCUMENTS

| | | | | | |
|---|---|---|---|---|---|
| 3,452,838 | A | * | 7/1969 | Gabrielson et al. | 182/28 |
| 3,837,034 | A | * | 9/1974 | Leffert et al. | 15/257.06 |
| 3,895,772 | A | * | 7/1975 | Ellingson | 248/210 |
| 3,899,045 | A | * | 8/1975 | Geisel | E06C 7/16 182/121 |
| 4,274,508 | A | * | 6/1981 | Hughes | E06C 7/16 135/100 |
| 4,519,476 | A | * | 5/1985 | Alimbau Marques et al. | 182/28 |
| 4,625,656 | A | * | 12/1986 | Brickman | 108/25 |
| 5,052,581 | A | * | 10/1991 | Christ | E06C 7/14 15/257.06 |
| 5,327,838 | A | * | 7/1994 | Beltman | 108/25 |
| 5,358,069 | A | * | 10/1994 | Krause | 182/118 |
| 5,429,205 | A | * | 7/1995 | Collins | E06C 7/16 182/122 |
| 5,626,205 | A | * | 5/1997 | Martin | 182/153 |
| 5,711,400 | A | * | 1/1998 | Tan | 182/119 |
| 6,591,831 | B2 | * | 7/2003 | Reynolds | 126/33 |

(Continued)

OTHER PUBLICATIONS definition of "ladder" found in Action The American Heritage® Dictionary of the English Language, Fourth Edition copyright © 2000 by Houghton Mifflin Company. Updated in 2009. Published by Houghton Mifflin Company. All rights reserved.*

*Primary Examiner* — Daniel Cahn

(74) *Attorney, Agent, or Firm* — Palmer C. DeMeo; Palmer Patent Consultants, LLC

(57) ABSTRACT

This invention is directed to providing an entertainment table from a readily accessible ladder, preferably an extension ladder, available in most households. In particular, the ladder is supported by a pair of saw-horse type supports at opposite ends of the ladder and various sized and shaped open-ended containers with extensions at their respective open ends are supported from and between pairs of spaced rungs of the ladder. The ladder may also be provided with an elongated planar support with one or more various sized and shaped openings therein and which planar support is supported by and along the rungs of the ladder or by and along the rails of the ladder. Also, the ladder may be provided with a plurality of support plates aligned side by side and supported by the opposing rails of the ladder with some of said support plates having a shaped opening therein. Various sized and shaped open-ended containers with peripherally extending lips are placed within the various sized and shaped openings of the elongated planar support or the aligned side-by-side support plates.

6 Claims, 11 Drawing Sheets

(56) References Cited

U.S. PATENT DOCUMENTS

| | | | | |
|---|---|---|---|---|
| 7,270,216 | B2 | 9/2007 | Elliot | |
| 2002/0020304 | A1* | 2/2002 | Reynolds | 99/339 |
| 2003/0066709 | A1 | 4/2003 | Elliot | |
| 2004/0083903 | A1* | 5/2004 | Wei-Wen | 99/448 |
| 2004/0083904 | A1* | 5/2004 | Wei-Wen | 99/448 |
| 2006/0288997 | A1* | 12/2006 | Griffin | 126/33 |
| 2007/0240937 | A1* | 10/2007 | Borgstede | 182/129 |

* cited by examiner

ENTERTAINMENT TABLE

BACKGROUND OF THE INVENTION

1. Field of the Invention

The present invention relates to a table for entertainment purposes.

2. Description of the Prior Art

There have been numerous types of tables used for indoor and outdoor entertainment purposes including one or more indoor tables such as kitchen and dining room tables, folding tables, etc. or one or more picnic tables. For large gatherings of people requiring a large number of food servings, several tables may be aligned adjacent one another to provide a setting for the large number of food servings. There is a need to have a readily available table to accommodate various entertainment occasions and the use of a ladder and supports therefor as described in this specification fulfills this need. The use of a ladder and supports therefor to provide a working table for power tools is known in the art such as disclosed in U.S. 2003/0066709, U.S. 2007/0240937 and U.S. Pat. No. 7,270,216. However, the present invention provides a unique and easily accommodating means for an entertainment table with the use of a ladder and various, specially designed containers, trays and attachments associated therewith. No such entertainment table in the prior art presently exists.

SUMMARY OF THE INVENTION

The main purpose of this invention is to provide an entertainment table by using a ladder or an extension ladder commonly found and available in most households. Specially designed containers, e. g., food containers, are used and supported by the rungs of the ladder. Other specially designed containers may be used and supported by extended plates with various sized openings therein which extended plates are, in turn, supported either by the rungs along the length of the ladder or by the opposing rails along the length of the ladder. Specially designed individual plates with an opening or with various sized openings therein may also be used and aligned adjacent each other; the plates being supported by the opposing rails along the length of the ladder. Various sized and shaped containers such as food containers are supported within the various sized openings of the specially designed individual plates or of the extended plates. An extension ladder either in the non-extended or extended mode can be used as an integral part of the entertainment table. Alternatively, a non-extension ladder may also be used. The entertainment table of this invention may be used for a variety of different occasions, for examples, indoor or outdoor family parties or social gatherings, church dinners or picnics, or catering services such as wedding receptions or banquets.

Other objects and advantages in the use of the entertainment table of this invention will become apparent upon reading the following description of which the attached drawings form a part.

DETAILED DESCRIPTION OF THE PREFERRED EMBODIMENTS

Figure 1:
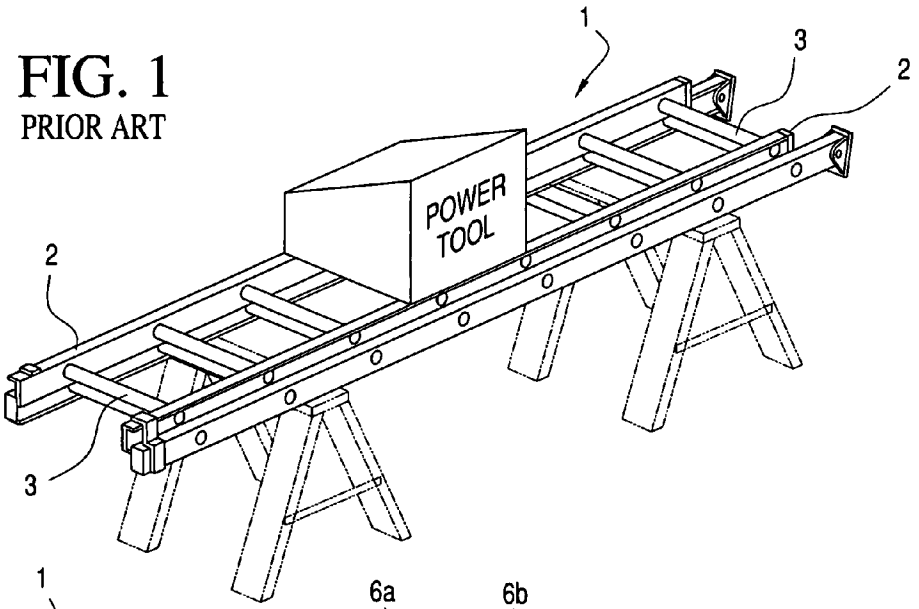
FIG. 1 PRIOR ART
FIG. 1 is a perspective view of a prior art ladder support system for supporting a power tool.

FIG. 1 shows a prior art support system for supporting a power tool on an extension ladder 1 which, in turn, is supported by oppositely spaced sawhorses 4.

Figure 3B:
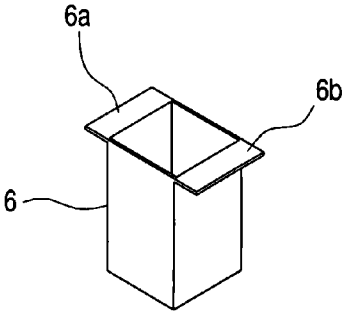
FIG. 3*a* shows a side view of a typical container 6 which may be used in the first embodiment of this invention and FIG. 3*b* shows a perspective view of that container 6.
Figure 3A:
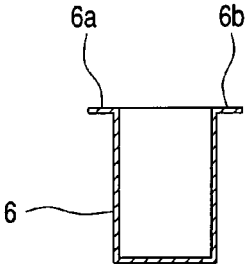
Figure 2:
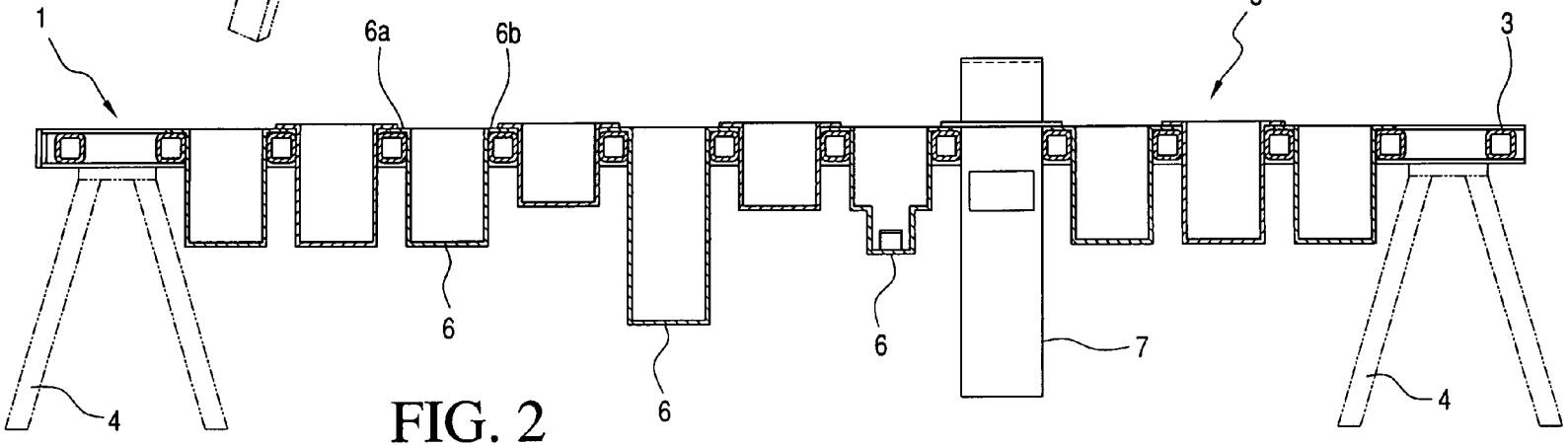
FIG. 2 is a longitudinal, cross-sectional view of a first embodiment of an entertainment table with a plurality of various sized containers supported by the rungs along the length of the ladder.

FIG. 2 shows a first embodiment of an entertainment table 5 of the present invention. The entertainment table 5 comprises a ladder 1 supported by oppositely spaced sawhorses 4, 4 with a plurality of various sized containers 6 supported between and by oppositely spaced rungs 3 of the ladder 1. Although sawhorses are shown as supporting the entertainment table 5 of this invention other support structures may also be used. The extension ladder may, for example, be a five foot aluminum ladder which extends to ten feet, an eight foot ladder which extends to sixteen feet, etc. Aluminum extension ladders vary in width but for example purposes of this invention an aluminum extension ladder with a top section width of 16½ inch and a bottom section width of 17½ inch is used. However, ladders other than extension ladders may also be used and made from materials such as wood, fiberglass, magnesium as well as aluminum. Utilizing, for example, an eight foot extension ladder 1 for the entertainment table 5 of this invention, the spaced rungs of this section of the extension ladder 1 will support 8 containers and when the extension ladder 1 is extended fully to 16 feet then the extended section of this ladder 1 will support an additional 8 containers for a total support of 16 containers. Each of the containers 6 has a pair of oppositely spaced side extensions 6*a* and 6*b* as shown in FIGS. 3*a* and 3*b*. The oppositely spaced side extensions 6*a* and 6*b* of a particular container 6 are supported by a pair of adjacently spaced rungs 3 of the extension ladder 1 as shown in FIG. 2. The oppositely spaced side extensions 6*a* and 6*b* of a particular container 6 may overlap or underlie a side extension 6*a* or 6*b* of adjacently positioned containers 6. The containers 6 may be food containers. Container 7 may be, for examples, an ice container or a barbecue grill.

FIGS. 3*a* and 3*b* show a typical container 6 which may be used with the first embodiment of the present invention and wherein 6*a* and 6*b* are oppositely spaced side extensions 6*a* and 6*b* used for supporting the container 6 from oppositely spaced adjacent rungs 3 of the extension ladder 1. The container 6 is approximately 10 inches wide, 13½ inches in length and can vary in depth. Each of the oppositely spaced side extensions 6*a* and 6*b* is approximately 1½ inch wide.

Figures 4, 5, 7:
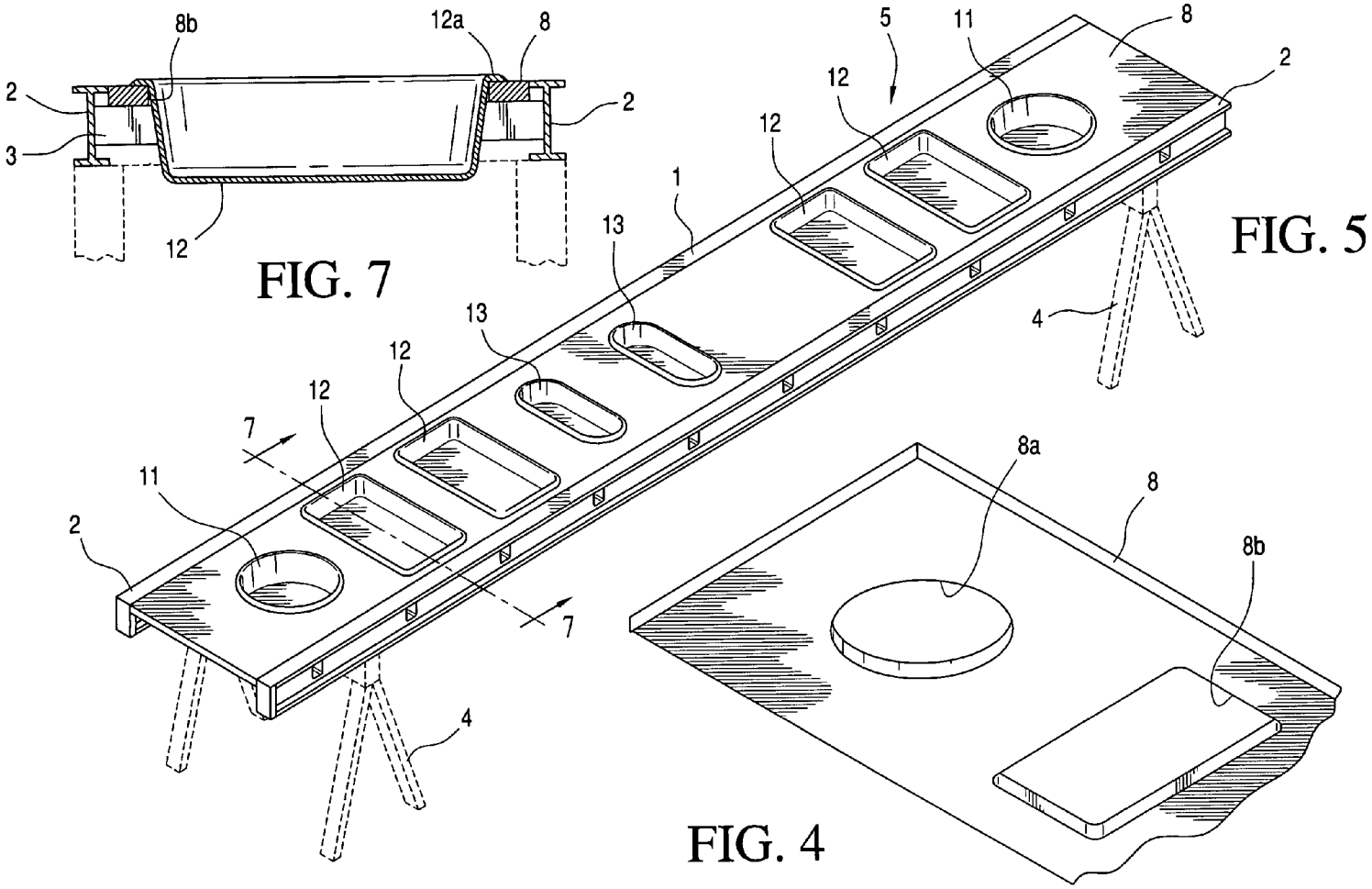
FIG. 4 is a perspective view of an elongated support plate with a plurality of various sized and shaped openings therein.
FIG. 5 is a perspective view of an entertainment table with the elongated support plate of FIG. 4 positioned between the rails and supported by the rungs of the ladder.
FIG. 7 is a cross-sectional view of the entertainment table taken along lines 7-7 of FIG. 5.

FIGS. 4 and 5 are directed to a second embodiment of an entertainment table 5 of the present invention. FIG. 4, in particular, shows an elongated support plate 8 with a plurality of various sized and shaped openings, e. g., 8*a*, 8*b* therein. FIG. 5 shows a second embodiment of an entertainment table 5 of the present invention wherein the elongated support plate 8 of FIG. 4 is supported on the rungs 3 and between the rails 2, 2 of the ladder 1. (In order to simplify the drawings, the bottom section of the extension ladder 1 has been omitted from FIG. 5.) Within each of the openings, e. g., 8*a*, 8*b* a correspondingly shaped container, e. g., 11 or 12, is supported therein as shown in FIG. 5. As an example, for an eight foot extension ladder 1, the length of the elongated support plate 8 is approximately 8 feet for a first section of the extension ladder 1; the width of the elongated support plate 8 is approximately 15 inches with a thickness of approximately 1 mil to ½ inch depending on the material of the elongated support plate 8. The length for a second or extended section of the eight foot extension ladder 1 will be the same, i. e., 8 feet, the thickness will be the same as the first section but the width will be less, e. g., 14 inches. The elongated support plate 8 may be made from wood, metal or plastic.

Figure 6E:
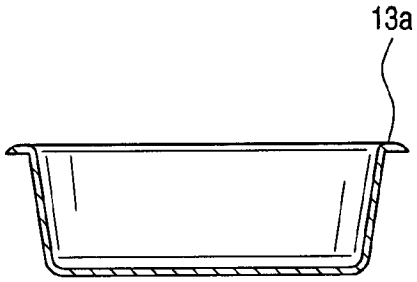
FIGS. 6*a*-6*b*, 6*c*-6*d*, and 6*e*-6*f* show respective side and perspective views of three differently shaped containers.
Figure 6F:
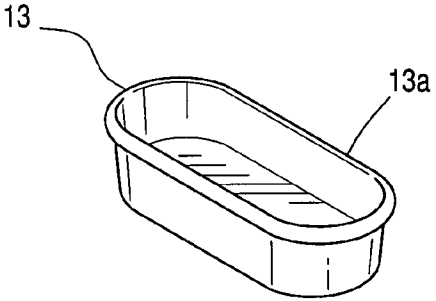
Figure 6C:
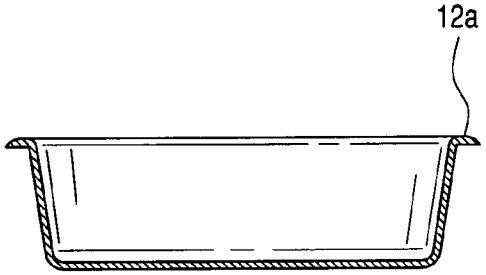
Figure 6D:
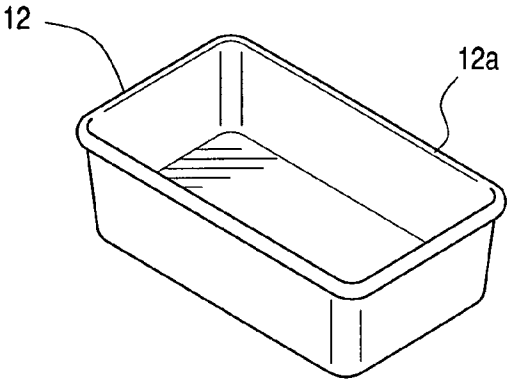
Figure 6A:
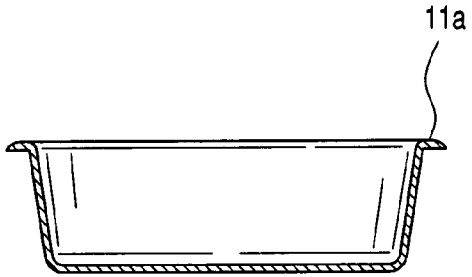
Figure 6B:
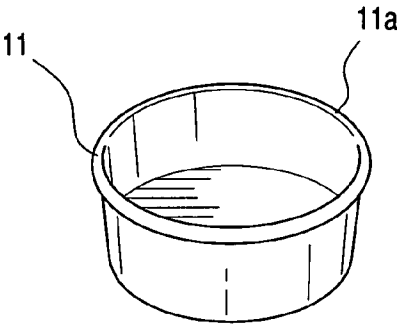

FIGS. 6*a*-6*b* show a side and perspective view, respectively, of a circular shaped container 11 which may be used in the entertainment table 5 of FIG. 5. The container 11 has an outwardly extending circumferential lip 11 a for supporting it within an opening 8*b* of the elongated support plate 8. FIGS. 6*c*-6*d* show a side and perspective view, respectively, of a rectangular shaped container or tray 12 which may be used in the entertainment table 5 of FIG. 5. The container 12 has an outwardly extending circumferential lip 12*a* for supporting it within opening 8*b* of the elongated support plate 8. FIGS. 6*e*-6*f* show a side and perspective view, respectively, of an oblong shaped container 13 which may be used in the entertainment table 5 of FIG. 5. The container 13 has an outwardly extending circumferential lip 13*a* for supporting it within a correspondingly shaped opening (not shown) of the elongated support plate 8. These three containers are only some examples of particular shaped containers that may be used with the entertainment table 5 of the present invention. The length of the lips 11*a*, 12*a* or 13*a* of the various shaped containers may vary from ¼ inch to approximately 1 inch. Obviously, other shaped containers, with correspondingly shaped openings in the elongated support plate 8, may also be used.

FIG. 7 shows a cross sectional view of the entertainment table 5 taken along lines 7-7 of FIG. 5 wherein a container or tray 12, having an outwardly extending circumferential lip 12*a*, is supported within the opening 8*b* of the elongated support plate 8. The elongated support plate 8 is supported by the rungs 3 of the ladder 1, one of the rungs 3 being shown in FIG. 7.

Figures 8, 9, 10:
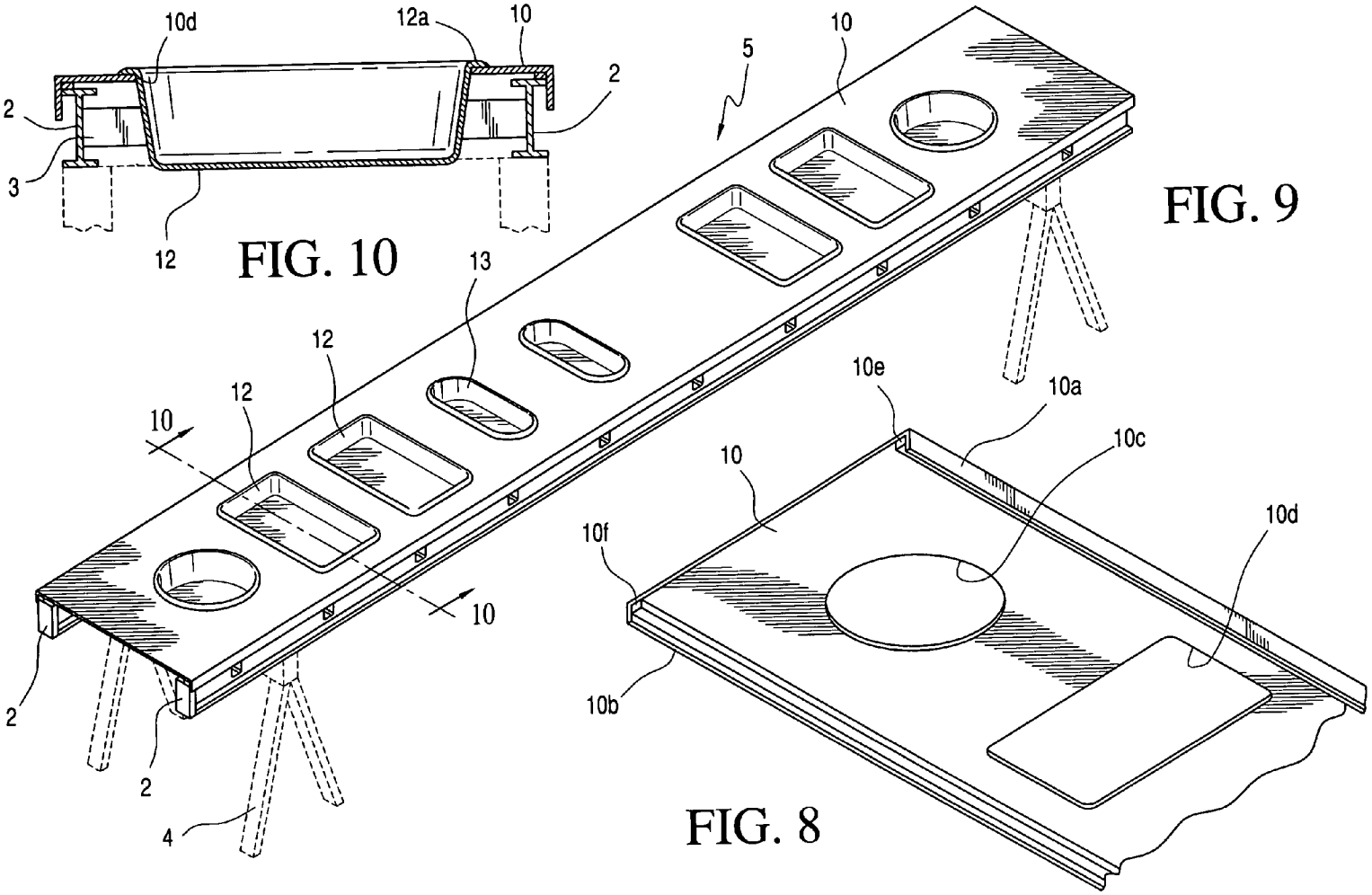
FIG. 8 is a perspective view of an alternative elongated support plate with a plurality of various sized and shaped openings therein.
FIG. 9 is a perspective view of an entertainment table with the elongated support plate of FIG. 8 supported on and between the opposite rails of the ladder.
FIG. 10 is a cross-sectional view of the entertainment table taken along lines 10-10 of FIG. 9.

Referring now to FIGS. 8, 9, and 10. These figures show a third embodiment of the entertainment table 5 of this invention. In FIG. 8 there is shown another elongated support plate 10 with downwardly bent side extensions 10*a* and 10*b* and with various sized/shaped openings therein, only two of which are shown as 10*c* and 10*d*. Along the length of the support plate 10 between the bottom side of the plate 10 and each of the downwardly bent side extensions 10*a* and 10*b* is a strip 10*e* and 10*f* respectively for providing a snug fit over the opposing rails 2, 2 of the top section of the extension ladder 1 should the extension be used. Each strip 10*e* and 10*f* is located ¼ inch below the free end of the downwardly bent side extension 10*a* or 10*b* (respectively), ½ inch wide and ¼ inch thick. The elongated support plate 10 is preferably made from stainless steel but may also be made from other materials such as aluminum, plastics, ceramics, etc. As shown in FIG. 9, the elongated support plate 10 is supported by the opposing rails 2, 2 of the extension ladder 1 and various sized and shaped containers 11, 12 and 13 are positioned within the various sized and shaped openings in the elongated support plate 10. FIG. 10 is a cross sectional view of the entertainment table taken along lines 10-10 of FIG. 9 wherein a container 12, having an outwardly extending circumferentially lip 12*a*, is supported within the opening 10*d* of the elongated support plate 10.

Figure 11:
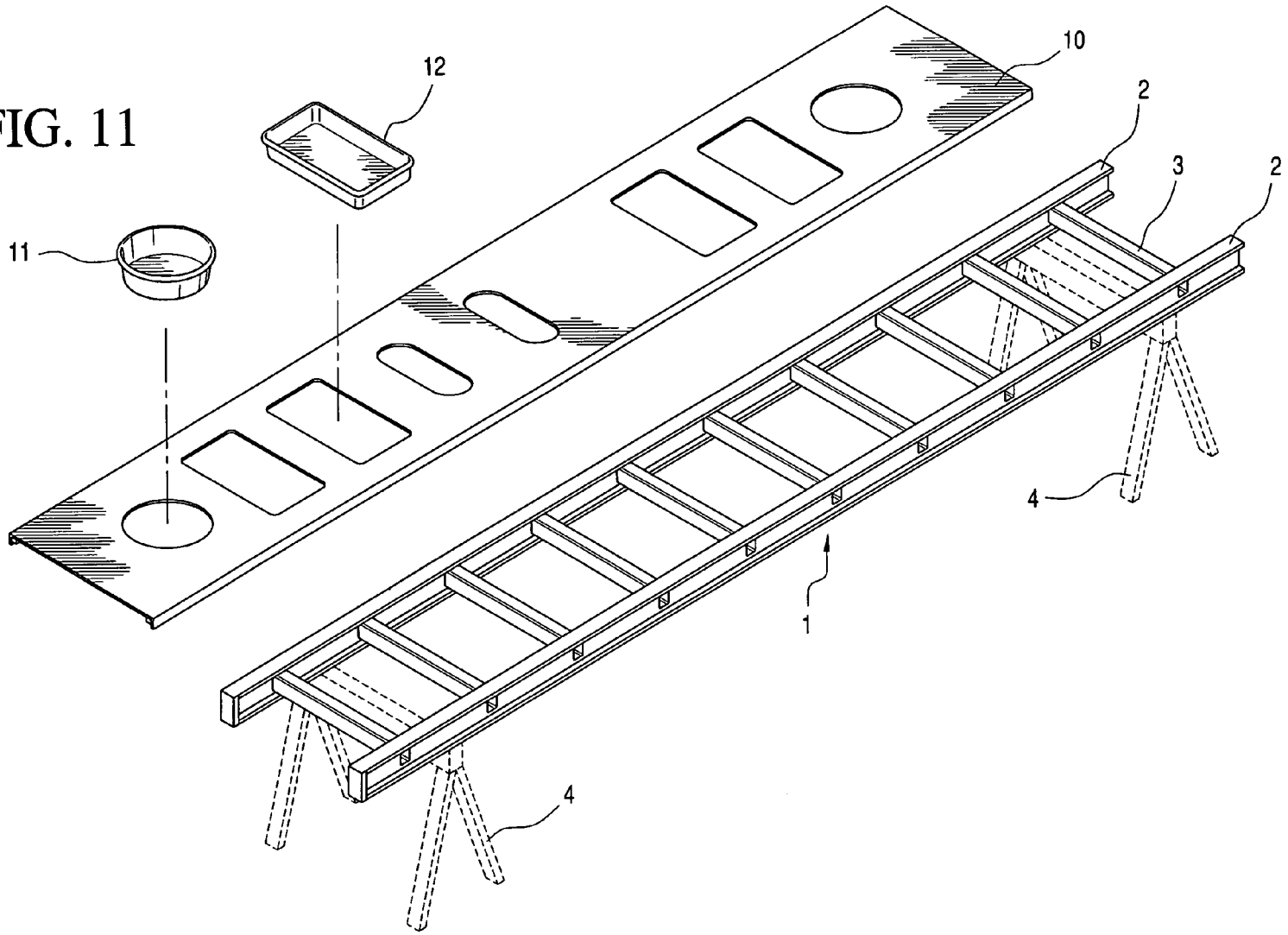
FIG. 11 is a spaced perspective view of the entertainment table shown in FIG. 9 with only two of the food containers shown.

FIG. 11 shows in a step-wise manner how the components of the entertainment table 5 are assembled. For the sake of simplicity, only two of the containers 11 and 12 are shown in the figure.

Figures 12, 13, 14, 15:
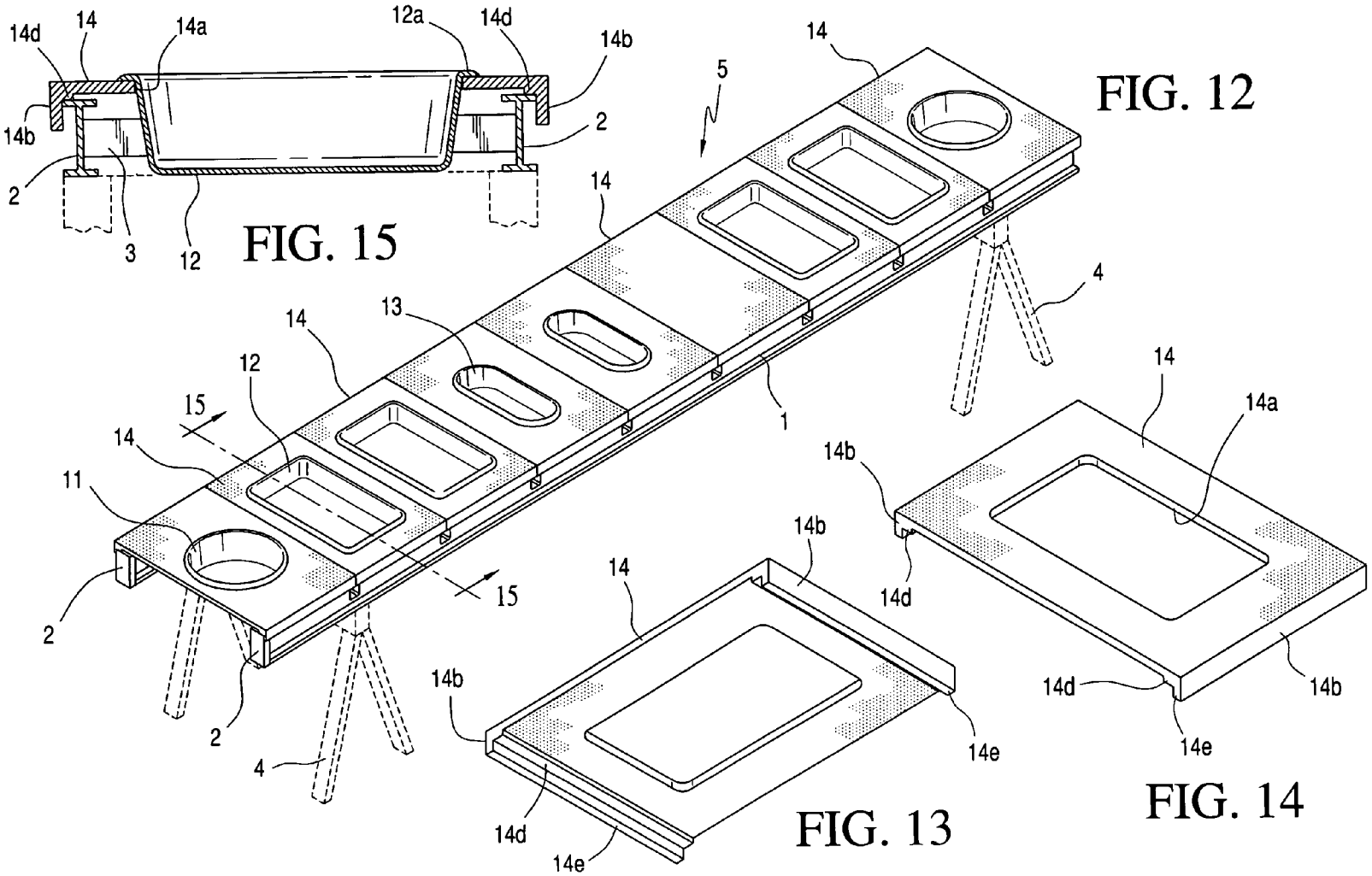
FIG. 12 is a perspective view of an alternative entertainment table with a plurality of longitudinally and adjacently positioned support plates supported by the opposing rails of an extension ladder.
FIG. 13 is a bottom perspective view of one example of an apertured support plate usable with the alternative entertainment table of FIG. 12.
FIG. 14 is a top perspective view of the aperture support plate shown in FIG. 13.
FIG. 15 is a cross sectional view of the entertainment table taken along lines 12-12 of FIG. 12.

Referring now to FIGS. 12, 13, and 14. These figures show a fourth embodiment of the entertainment table 5 of the present invention utilizing a plurality of specially designed support plates 14 which support plates are supported by the opposing rails 2, 2 along the length the extension ladder 1. For the sake of simplicity, only the bottom section of the extension ladder 1 is shown in FIG. 12. Each of the support plates 14 may have a configured opening therein or no opening therein. As shown in FIG. 12 and as an example only, there are nine support plates 14 aligned adjacent one another along the length of the ladder 1; eight of the plates 14 have an opening therein and one of the plates 14 does not. Also shown in FIG. 12 are several differently sized and shaped containers 11, 12, and 13 supported within a corresponding opening in a respective support plate 14. Support plate 14 without an opening therein can serve to support serving utensils, condiment containers, glasses, beverage containers such as bottles or pitchers and/or even decorative items such as candelabra. The support plates 14 of this invention can be made from a number of different materials such as: stainless steel, hard or soft metals, hard or soft plastics, ceramic, marble, stone, granite, or Formica.

One of the support plates that is used in the fourth embodiment of the entertainment table 5 shown in FIG. 12 is the rectangular shaped support plate 14 shown in FIGS. 13 and 14. This particular support plate 14 has a rectangular shaped opening 14*a* therein and is designed to fit over the opposing rails 2, 2 of either the top or bottom section of the extension ladder 1. The support plate 14 has a width of 12 inches and a length of 18½ inches. The support plate 14 has a pair of downwardly extending sections 14*b*, 14*b* at opposite sides thereof as shown in FIGS. 13 and 14. Between the underside surface 14*c* and each of the downwardly extending sections 14*a* and 14*b* is an elongated strip 14*d* which is ¼ inch below the free edge 14*e* of a respective downwardly extending section 14*a* and 14*b*. Each elongated strip 14*d* is ½ inch wide and has a depth of ¼ inch. In view of these strips 14*b*, 14*b* on the underside of each support plate 14, each support plate 14 is capable of fitting over the opposing rails 2, 2 of the bottom section of an extension ladder 1 having a width of 17½ inches or over the opposing rails 2, 2 of the top section of an extension ladder 1 having a width of 16½ inches. This particular support plate 14 has a central opening that is 9 inches wide and 12 inches long. However, each of the other support plates 14, having a different sized and shaped opening(s) therein, has elongated strips 14*d*, 14*d* on the bottom or underside thereof such that each such support plate 14 can fit over the opposing rails 2, 2 of either the top or bottom section of the extension ladder 1.

FIG. 15 is a cross sectional view of the entertainment table 5 taken along lines 12-12 of FIG. 12 wherein a rectangular shaped container or tray 12, having an outwardly extending peripheral lip 12*a*, is supported within the rectangular shaped opening 14*a* of a singular support plate 14. As shown in FIG. 15, the support plate 14 is, in turn, positioned over and supported by the opposing rails 2, 2 of the bottom section of the extension ladder 1.

Figure 16:
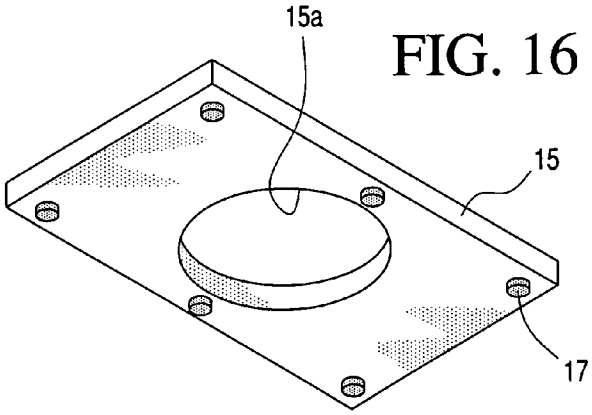
FIG. 16 is bottom perspective view of an apertured support plate usable in conjunction with the apertured support plate shown in FIGS. 13 and 14.
Figure 17:
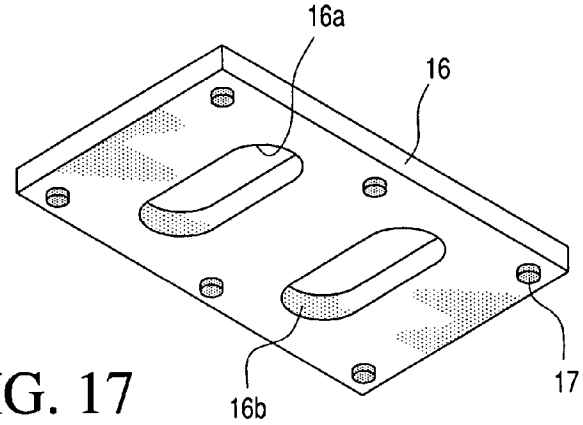
FIG. 17 is a bottom perspective view of another apertured support plate usable in conjunction with the apertured support plate shown in FIGS. 13 and 14.
Figure 18:
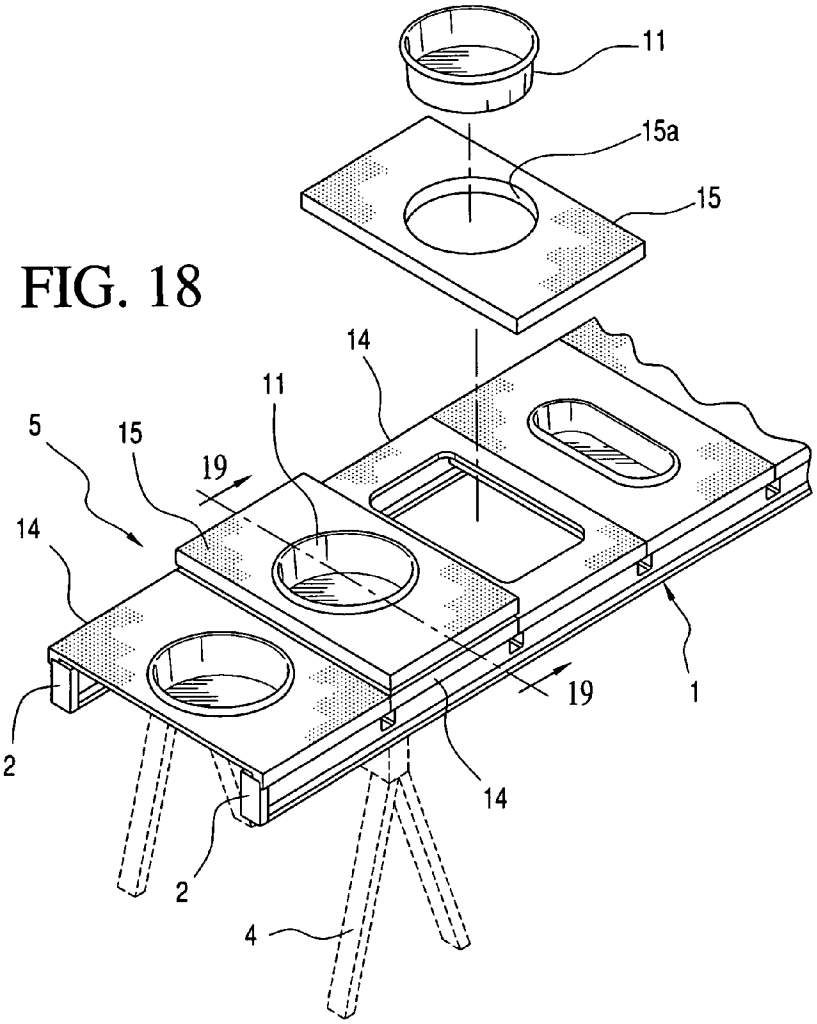
FIG. 18 is a partially spaced perspective view of the entertainment table showing the positioning of the apertured support plate of FIG. 16 with a circular opening over the apertured the support plate of FIG. 14 with a rectangular opening.
Figure 19:
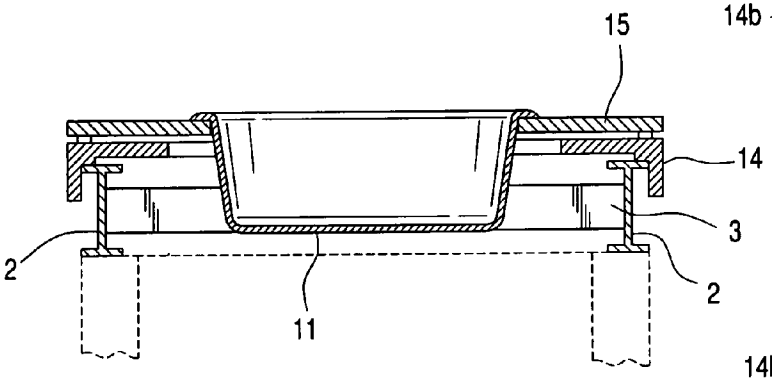
FIG. 19 is a cross sectional view of the entertainment table taken along lines 18-18 of FIG. 18.

Referring now to FIGS. 16, 17, 18 and 19. FIGS. 16 and 17 show two different apertured support plates 15 and 16 which can be used in conjunction with the apertured support plate 14 of the fourth embodiment of the entertainment table 5 of this invention. Support plate 15 has a circular opening 15*a* therein and severally spaced non-skid pads 17 made from rubber or other non-skid material on the bottom side of the support plate 15. Support plate 16 has two oblong shaped openings 16*a* and 16*b* therein and severally spaced non-skid pads 17 made from rubber or other non-skid material on the bottom side of the support plate 16. Each of these support plates 15 and 16 is rectangular in shape and has overall dimensions similar to those of rectangular plate 14. These plates provide more versatility to the fourth embodiment of the entertainment table 5 of this invention and either of these support plates can be used with the fourth embodiment of the entertainment table 5 of this invention. For example, it may be necessary to provide two additional apertured support plates 15 with a circular opening 15*a* therein to the entertainment table 5 without the extra steps of removing two of the already positioned apertured plates 14, 14 with a rectangular opening therein and, to do so, would save time and energy. Such is accomplished as shown in FIG. 18 where the apertured support plate 15 is positioned over the fixed apertured support plate 14 supported on the ladder 1 and another apertured support plate 15 to be positioned over another fixed apertured support plate 14 supported on the ladder 1. As shown in FIG. 18, a circular container 11 is positioned in each of the circular openings 15*a* of the support plates 15, 15. FIG. 19, which shows a cross sectional view taken along lines 18-18 of FIG. 18, more clearly shows the relative positioning of the container 11, the apertured support plate 15, the aperture support plate 14, and the opposing rails 2, 2 of the ladder 1. Instead of using the support plate 15 on each of the support plates 14 support plates 16 may be used or alternatively a combination of one support plate 15 and another support plate 16 may be used depending on the food containers necessary. Although two particular support plates 15 and 16 are disclosed other support plates with differently sized/shaped openings may also be used.

Figure 20:
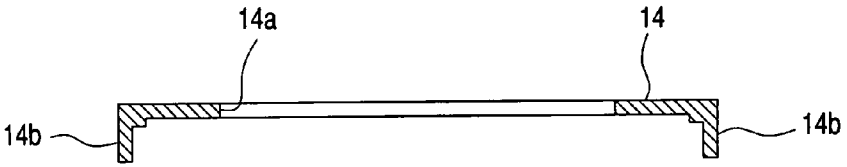
FIG. 20 is a cross sectional view of an apertured support plate with a rectangular shaped opening therein.
Figure 21:
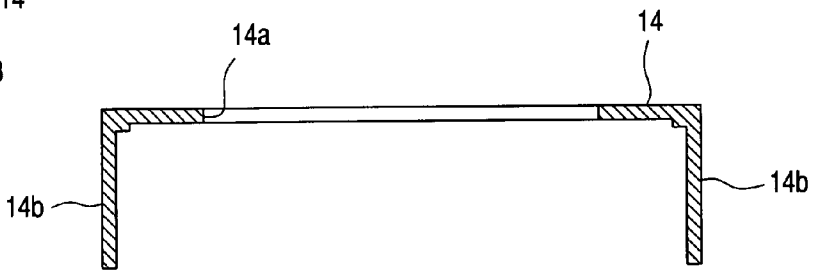
FIG. 21 is a cross sectional view of an alternative apertured support plate with a rectangular shaped opening therein.
Figure 22:
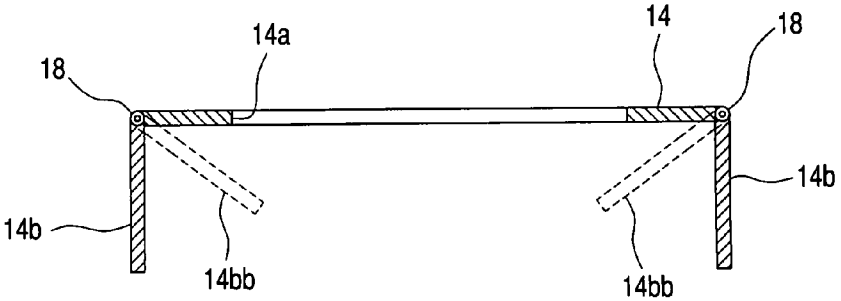
FIG. 22 is a cross sectional view of a hinged apertured support plate with a rectangular shaped opening therein.

Referring now to FIGS. 20, 21 and 22. FIG. 20 shows one example of a support plate 14 with a rectangular opening 14*a* therein and with downwardly extending opposing sections 14*b*, 14*b* of approximately one inch in length. However, in order to cover the top and bottom sections of the extension ladder 1 the length of the downwardly extending opposing sections 14*b*, 14*b* of the support plate 14 shown in FIG. 21 should be approximately six inches. FIG. 22 shows a support plate 14 similar to that shown in FIG. 21 but with the downwardly extending opposing sections 14*b*, 14*b* having hinges 18, 18 so that they can be folded upwardly as indicated by the dashed lines 14*bb*, 14*bb* depicted in FIG. 22. The purpose of the hinged embodiment of the support plate 14 is so that the support plates 14 can be easily stored when not in use. The embodiments of the support plate 14 shown in FIGS. 20, 21 and 22 are also applicable to the other support plates 14 having a differently shaped opening therein.

Figure 23:
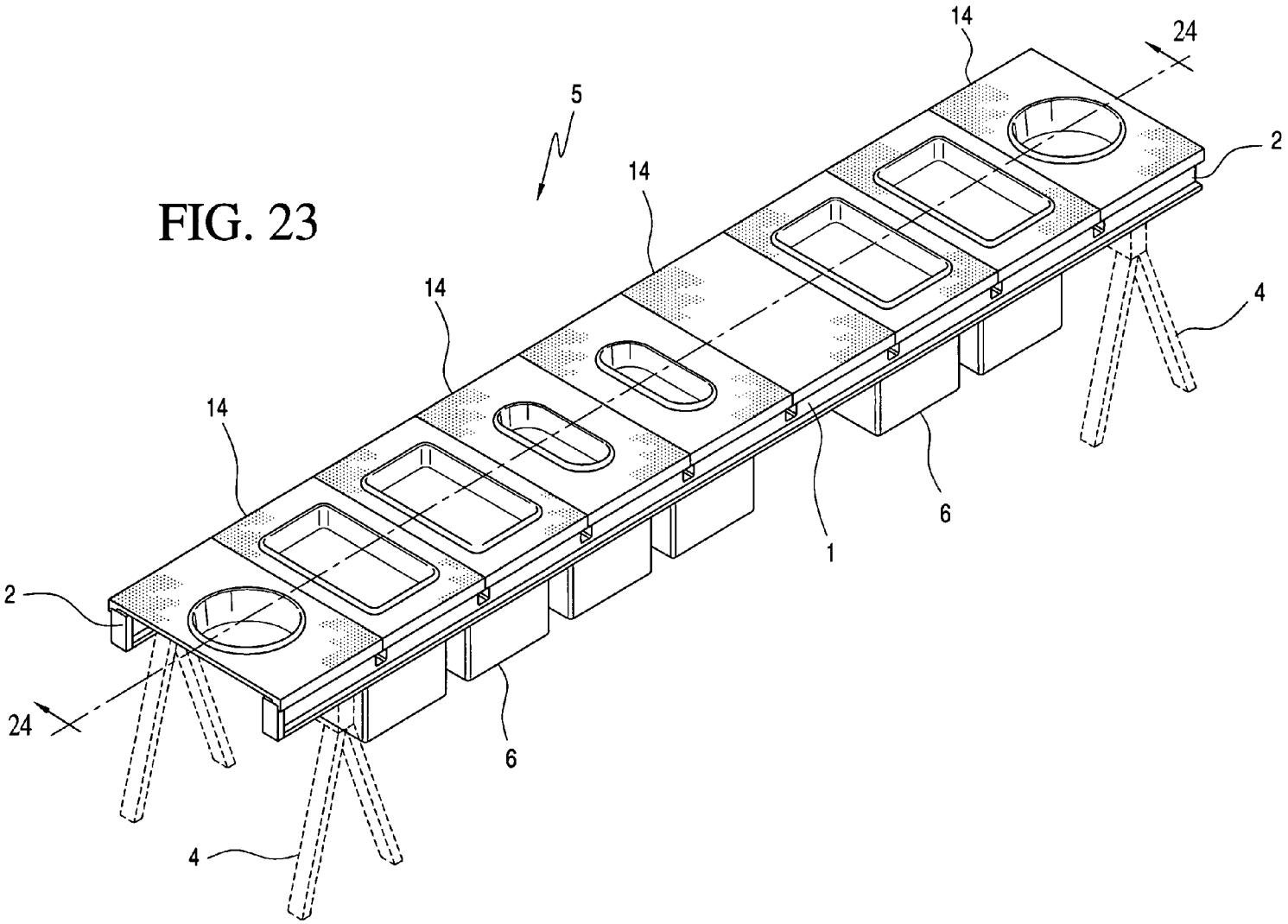
FIG. 23 is a perspective view of an alternative entertainment table combining the features of FIG. 12 with sub storage containers.
Figure 24:
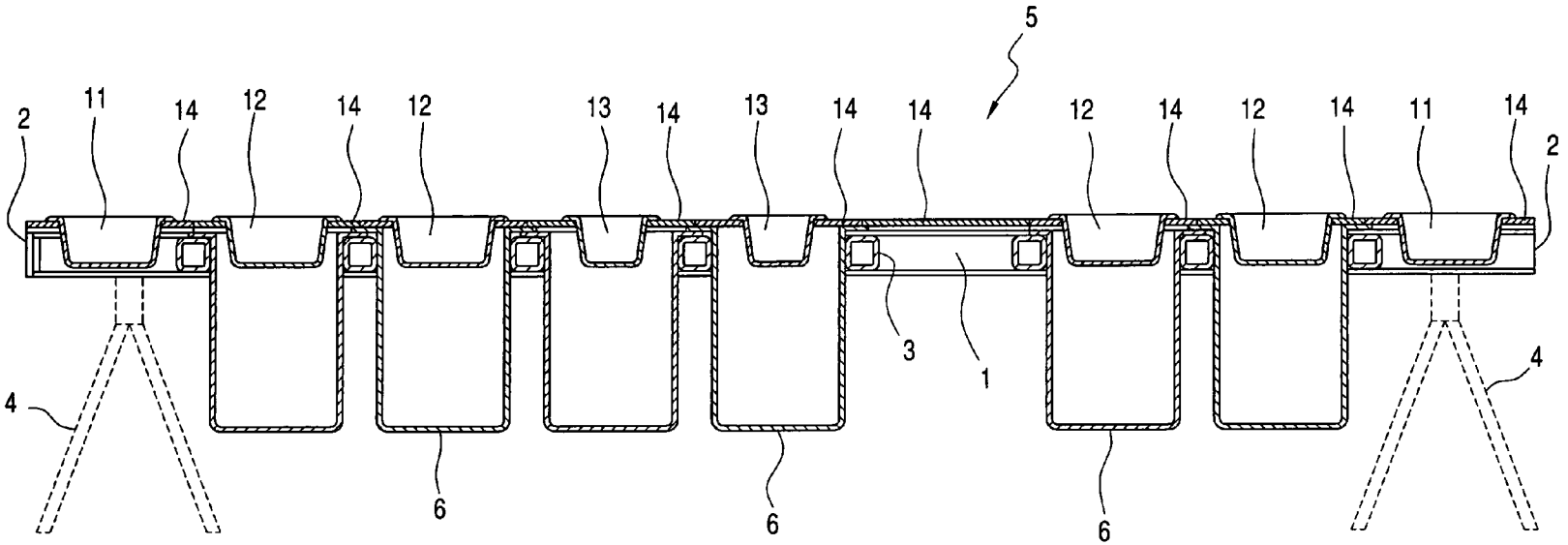
FIG. 24 is a cross-sectional view of the alternative entertainment table taken along lines 24-24 of FIG. 23.

FIGS. 23 and 24 show yet a fifth embodiment of the entertainment table 5 of the present invention which embodiment combines the features of FIG. 2 with the features of FIG. 12. The embodiment of FIGS. 23 and 24 includes the use of the support plates 14 supported by the opposite rails 2, 2 of ladder 1 and individual storage containers 6 beneath some of the containers 12, 13 supported by the respective support plates 14. Each of the storage containers 6 has opposite side extensions 6*a*, 6*b* at its open end which side extensions 6*a*, 6*b* are supported by a respective opposing pair of rungs 3, 3 of ladder 1. In this fifth embodiment of the entertainment table 5 of this invention, each of the storage containers 6 will have the same food item contained therein as the respective container above it, for example, as contained in container 12 so that when the food item in container 12 is depleted it can be refilled from the storage container 6 below it.

Figure 25:
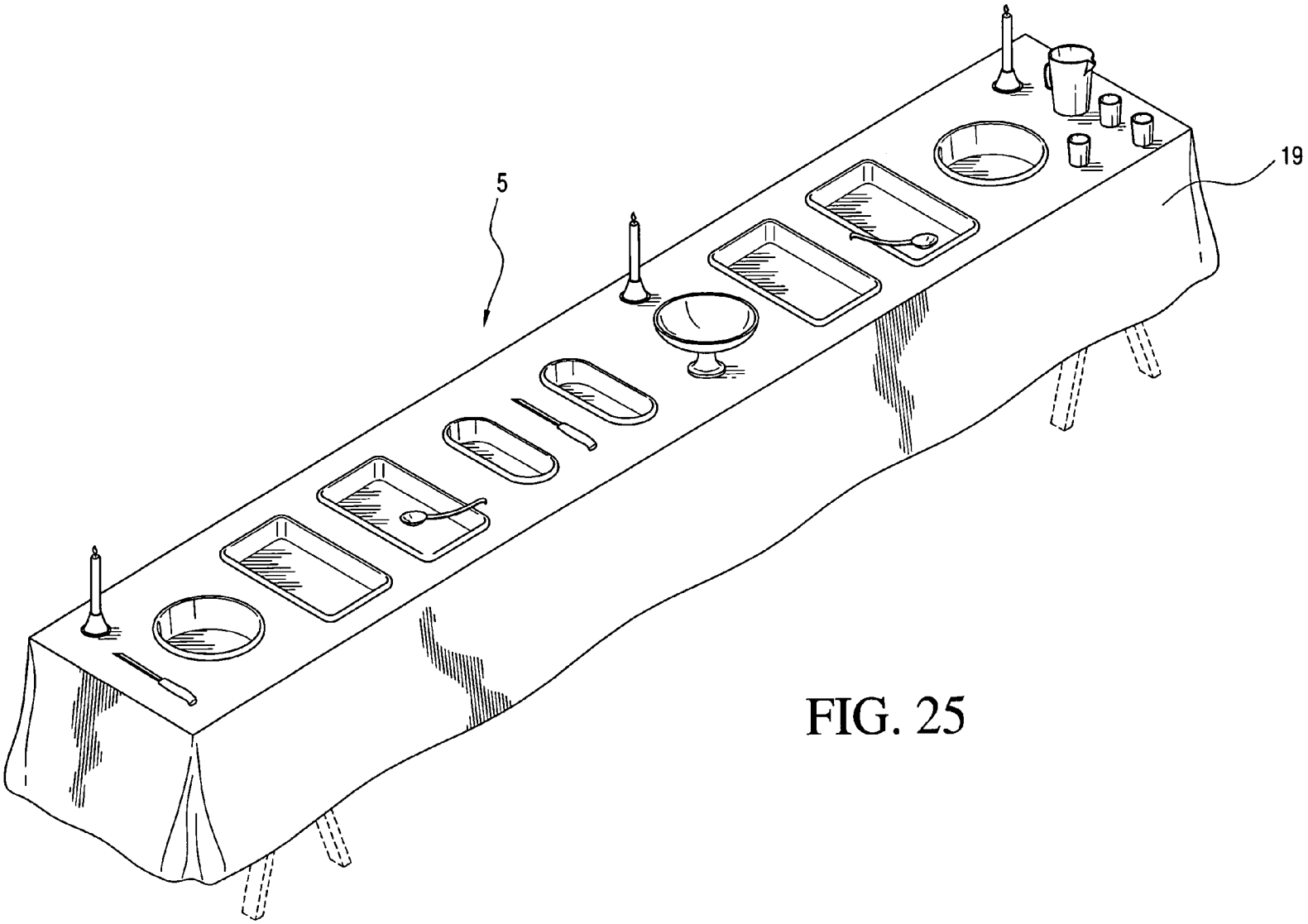
FIG. 25 is an example of an entertainment table of this invention with a skirt.

Finally, FIG. 25 shows only one example of the entertainment table 5 of this invention with a tablecloth or skirt 19 attached thereto.

Although the use of an extension ladder has been utilized in the various embodiments of the entertainment table 5 of this invention other types of ladders may also be used for the entertainment table of this invention such as a single layer ladder made from wood, plastic or metal. Although conventional ladders found in a household or in construction work are used for the various embodiments of the entertainment table of this invention, other structures similar to a ladder may also be used.

Although the table of the present invention is primarily directed for use as an entertainment table, other functions for this table are also possible, for example, as a work table for storing various carpentry, electrical or plumbing hardware, fixtures or tools.

Modification of this invention will be readily apparent to those skilled in the art and it is intended that the invention be not limited by the embodiments disclosed herein but that the scope of the invention be defined by the appended claims.

What is claimed is:

1. An entertainment table comprising an elongated ladder having a longitudinal length, a pair of opposing elongated rails and spaced rungs between said pair of opposing elongated rails and along the length of said elongated ladder, support stands at opposite ends of said elongated ladder, at least one open-ended container having a pair of opposing side extensions, and said pair of opposing side extensions of said at least one open-ended container being directly supported by adjacent said spaced rungs of said elongated ladder.

2. The entertainment table of claim 1 wherein said at least one open-ended container is a plurality of said open-ended containers, each of which is supported from separate pairs of spaced adjacent rungs of said elongated ladder.

3. The entertainment table of claim 2 wherein each of said plurality of open-ended containers is selected from a group consisting of various depth containers.

4. The entertainment table of claim 3 wherein each of said plurality of open-ended containers is rectangular in shape.

5. The entertainment table of claim 4 wherein each of said plurality of open-ended containers is made from metal, plastic or glass.

6. The entertainment table of claim 4 wherein each of said plurality of open-ended containers is a food container.

* * * * *